US009970284B2

(12) United States Patent
Tang et al.

(10) Patent No.: US 9,970,284 B2
(45) Date of Patent: May 15, 2018

(54) DOWNLINK PATH FINDING FOR CONTROLLING THE TRAJECTORY WHILE DRILLING A WELL

(75) Inventors: Yuxin Tang, Beijing (CN); Dandan Li, Beijing (CN); Yanyan Guan, Beijing (CN)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 244 days.

(21) Appl. No.: 13/584,827

(22) Filed: Aug. 14, 2012

(65) Prior Publication Data

US 2014/0049401 A1 Feb. 20, 2014

(51) Int. Cl.

| | |
|---|---|
| ***G01V 3/00*** | (2006.01) |
| ***E21B 44/00*** | (2006.01) |
| ***E21B 7/04*** | (2006.01) |

(52) U.S. Cl.

CPC ..... *E21B 44/00* (2013.01); *E21B 7/04* (2013.01)

(58) Field of Classification Search

CPC . E21B 44/00; E21B 7/04; E21B 7/067; E21B 47/09; E21B 47/02; E21B 47/022

USPC ..... 340/853.6

See application file for complete search history.

(56) References Cited

U.S. PATENT DOCUMENTS 3,898,880 A * 8/1975 Kelseaux ..... E21B 45/00 73/152.45
5,193,628 A * 3/1993 Hill et al. ..... 175/45
5,842,149 A * 11/1998 Harrell ..... E21B 44/00 702/9
6,523,623 B1 * 2/2003 Schuh ..... 175/45
7,000,710 B1 * 2/2006 Umbach ..... 175/62
7,299,131 B2 * 11/2007 Tabarovsky et al. ..... 702/7
7,730,967 B2 * 6/2010 Ballantyne ..... E21B 47/12 175/40
7,957,946 B2 6/2011 Pirovolou
8,151,905 B2 * 4/2012 Song ..... E21B 47/182 175/40
8,210,283 B1 * 7/2012 Benson ..... E21B 7/04 175/26
8,528,663 B2 * 9/2013 Boone ..... 175/45
8,596,385 B2 * 12/2013 Benson et al. ..... 175/61
8,672,055 B2 * 3/2014 Boone ..... E21B 7/04 175/26
8,731,837 B2 * 5/2014 Mehta ..... E21B 47/00 702/106
9,007,231 B2 * 4/2015 Macpherson ..... G01V 3/18 175/40

(Continued)

FOREIGN PATENT DOCUMENTS

| | | |
|---|---|---|
| CN | 101457635 A | 6/2009 |
| EP | 1389298 B1 | 3/2011 |
| WO | 2012067611 A1 | 5/2012 |

OTHER PUBLICATIONS

Matheus et al., A Hybrid Approach to Closed-loop Directional Drilling Control using Rotary Steerable Systems, Jun. 1, 2012.*

(Continued)

*Primary Examiner* — Quang D Pham

(57) ABSTRACT

A method for drilling a well along a planned trajectory includes: receiving downhole data from a steerable drilling tool; processing the downhole data and creating a downlink path, the downlink path being recognizable by the steerable drilling tool; and controlling the trajectory of the steerable drilling tool based on the downlink path.

16 Claims, 5 Drawing Sheets

(56) References Cited

U.S. PATENT DOCUMENTS 9,027,671 B2 * 5/2015 Koederitz ..... E21B 44/00 175/26
9,027,673 B2 * 5/2015 Vail, III ..... E21B 33/10 175/100
9,051,781 B2 * 6/2015 Vail, III ..... E21B 4/02
9,057,245 B2 * 6/2015 Wassell ..... E21B 44/04
9,103,195 B2 * 8/2015 Gawski ..... E21B 7/04
9,334,723 B2 * 5/2016 Yang ..... E21B 7/06
9,359,882 B2 * 6/2016 Snyder ..... E21B 7/04
9,593,567 B2 * 3/2017 Pink ..... E21B 44/02
2003/0024738 A1 * 2/2003 Schuh ..... 175/45
2003/0221869 A1 * 12/2003 Ireland ..... E21B 47/00 175/40
2004/0112640 A1 * 6/2004 Hay ..... E21B 7/062 175/26
2004/0140112 A1 * 7/2004 Salminen ..... E21B 44/00 173/1
2005/0217896 A1 * 10/2005 Terentyev ..... E21B 44/00 175/40
2005/0279532 A1 * 12/2005 Ballantyne ..... E21B 47/12 175/40
2006/0203614 A1 * 9/2006 Harmon ..... G01V 1/42 367/57
2006/0225920 A1 * 10/2006 Treviranus ..... E21B 47/18 175/40
2006/0238201 A1 * 10/2006 Brune et al. ..... 324/338
2006/0243489 A1 * 11/2006 Wassell ..... E21B 17/073 175/57
2009/0038392 A1 * 2/2009 Alfred ..... E21B 44/00 73/152.46
2009/0044981 A1 * 2/2009 Sheppard et al. ..... 175/24
2009/0090555 A1 * 4/2009 Boone ..... E21B 7/04 175/45
2009/0121923 A1 * 5/2009 Mainds et al. ..... 342/185
2009/0187345 A1 * 7/2009 Blanz ..... G01V 1/40 702/6
2009/0288881 A1 11/2009 Mullins et al.
2010/0122847 A1 * 5/2010 Xia et al. ..... 175/41
2010/0139981 A1 6/2010 Meister et al.
2010/0243328 A1 * 9/2010 Rodriguez Herrera ..... 175/61
2010/0313646 A1 * 12/2010 Mehta ..... E21B 47/00 73/152.54
2011/0015911 A1 * 1/2011 Chen ..... 703/7
2011/0022319 A1 * 1/2011 Djikpesse et al. ..... 702/11
2011/0024191 A1 * 2/2011 Boone ..... E21B 7/04 175/45
2011/0155461 A1 * 6/2011 Hutniak ..... E21B 44/00 175/24
2011/0162888 A1 * 7/2011 McHugh ..... E21B 44/02 175/26
2011/0214920 A1 * 9/2011 Vail, III ..... E21B 33/10 175/57
2012/0048618 A1 * 3/2012 Zamanian et al. ..... 175/24
2012/0292110 A1 * 11/2012 Downton ..... E21B 47/022 175/45
2012/0316787 A1 * 12/2012 Moran ..... E21B 44/00 702/9
2013/0105221 A1 * 5/2013 Wassell ..... E21B 44/00 175/40
2013/0341091 A1 * 12/2013 Sugiura ..... E21B 7/04 175/24

OTHER PUBLICATIONS

"Greedy Algorithm" at http://en.wikipedia.org/wiki/Greedy_algorithm.
International Search Report and Written Opinion issued in PCT/US2013/054719 dated Nov. 25, 2013, 12 pages.
Search Report issued in European Patent Application No. 13829170.3 dated Feb. 23, 2016; 4 pages.
Examination Report issued in European Patent Application No. 13829170.3 dated May 24, 2016; 4 pages.
Cockburn et al., "Automatic Trajectory Control in Extended-Reach Wells", SPE 142671, SPE Middle East Oil and Gas Show and Conference, Sep. 25-28, 2011, 13 pages.

* cited by examiner

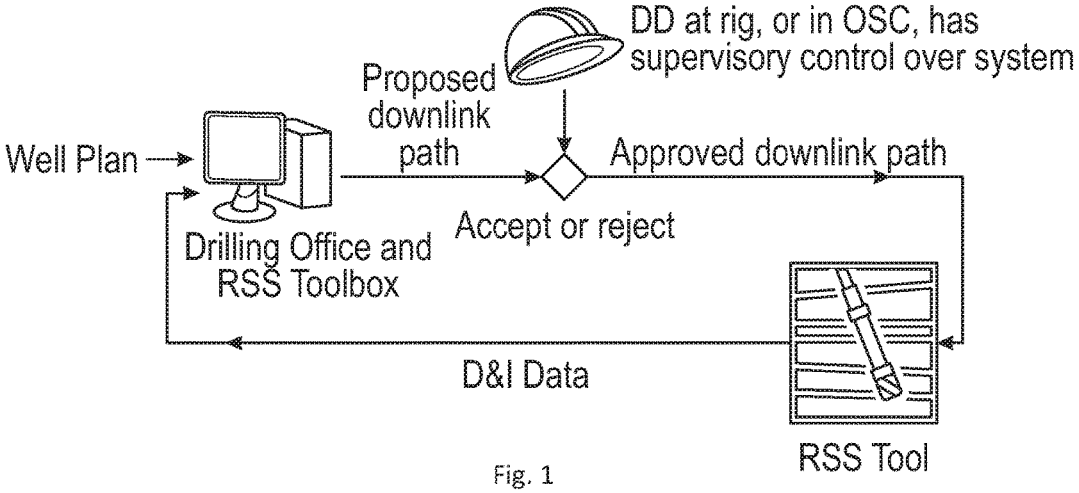

Fig. 1

| COMMAND # | STEERING MODE 0: SINGLE MODE | | |
|---|---|---|---|
| 1-0 | SET TF = 0 DEGREES, SR = 0% | 2-0 | SET TF = 252 DEGREES, SR = 50% |
| 1-1 | SET TF = 0 DEGREES, SR = 25% | 2-1 | SET TF = 252 DEGREES, SR = 100% |
| 1-2 | SET TF = 0 DEGREES, SR = 50% | 2-2 | SET TF = 270 DEGREES, SR = 25% |
| 1-3 | SET TF = 0 DEGREES, SR = 75% | 2-3 | SET TF = 270 DEGREES, SR = 75% |
| 1-4 | SET TF = 0 DEGREES, SR = 100% | 2-4 | SET TF = 270 DEGREES, SR = 100% |
| 1-5 | SET TF = 18 DEGREES, SR = 75% | 2-5 | SET TF = 288 DEGREES, SR = 50% |
| 1-6 | SET TF = 18 DEGREES, SR = 100% | 2-6 | SET TF = 288 DEGREES, SR = 100% |
| 1-7 | SET TF = 36 DEGREES, SR = 50% | 2-7 | SET TF = 306 DEGREES, SR = 75% |
| 1-8 | SET TF = 36 DEGREES, SR = 100% | 2-8 | SET TF = 315 DEGREES, SR = 25% |
| 1-9 | SET TF = 45 DEGREES, SR = 25% | 2-9 | SET TF = 324 DEGREES, SR = 50% |
| 1-10 | SET TF = 54 DEGREES, SR = 75% | 2-10 | SET TF = 324 DEGREES, SR = 100% |
| 1-11 | SET TF = 72 DEGREES, SR = 50% | 2-11 | SET TF = 342 DEGREES, SR = 75% |
| 1-12 | SET TF = 72 DEGREES, SR = 100% | 2-12 | SET TF = 342 DEGREES, SR = 100% |
| 1-13 | SET TF = 90 DEGREES, SR = 25% | 2-13 | INCREASE SR BY 10% |
| 1-14 | SET TF = 90 DEGREES, SR = 75% | 2-14 | DECREASE SR BY 10% |
| 1-15 | SET TF = 90 DEGREES, SR = 100% | 2-15 | INCREASE TF BY 12 DEGREES |
| 1-16 | SET TF = 108 DEGREES, SR = 50% | 2-16 | DECREASE TF BY 12 DEGREES |
| 1-17 | SET TF = 108 DEGREES, SR = 100% | 2-17 | INCLINATION HOLD. NO AZIMUTH |
| 1-18 | SET TF = 126 DEGREES, SR = 75% | 2-18 | INCLINATION HOLD. RIGHT AZIMUTH 25% |
| 1-19 | SET TF = 135 DEGREES, SR = 25% | 2-19 | INCLINATION HOLD. RIGHT AZIMUTH 50% |
| 1-20 | SET TF = 144 DEGREES, SR = 50% | 2-20 | INCLINATION HOLD. LEFT AZIMUTH 25% |
| 1-21 | SET TF = 144 DEGREES, SR = 100% | 2-21 | INCLINATION HOLD. LEFT AZIMUTH 50% |
| 1-22 | SET TF = 162 DEGREES, SR = 75% | 2-22 | NUDGE UP 0.5 DEGREE |
| 1-23 | SET TF = 180 DEGREES, SR = 25% | 2-23 | NUDGE DOWN 0.5 DEGREE |
| 1-24 | SET TF = 180 DEGREES, SR = 50% | 2-24 | DOWNLINK BIT PERIOD 18S |
| 1-25 | SET TF = 180 DEGREES, SR = 75% | 2-25 | DOWNLINK BIT PERIOD 36S |
| 1-26 | SET TF = 180 DEGREES, SR = 100% | 2-26 | DOWNLINK BIT PERIOD 54S |
| 1-27 | SET TF = 198 DEGREES, SR = 75% | 2-27 | USE GRAVITY MODE |
| 1-28 | SET TF = 216 DEGREES, SR = 50% | 2-28 | USE MAGNETIC MODE |
| 1-29 | SET TF = 216 DEGREES, SR = 100% | 2-29 | NOT USED |
| 1-30 | SET TF = 225 DEGREES, SR = 25% | 2-30 | NOT USED |
| 1-31 | SET TF = 234 DEGREES, SR = 75% | 2-31 | NOT USED |

Fig 2

DOWNLINK PATH FINDING FOR CONTROLLING THE TRAJECTORY WHILE DRILLING A WELL

BACKGROUND OF INVENTION

Field of the Invention

The invention relates generally to methods of directionally drilling wells, particularly wells for the production of hydrocarbon products. More specifically, it relates to a method of automatic control of a steerable drilling tool to drill wells along a planned trajectory.

Background Art

When drilling oil and gas wells for the exploration and production of hydrocarbons it is often desirable or necessary to deviate a well in a particular direction. Directional drilling is the intentional deviation of the wellbore from the path it would naturally take. In other words, directional drilling is the steering of the drill string so that it travels in a desired direction.

Directional drilling can be used for increasing the drainage of a particular well, for example, by forming deviated branch bores from a primary borehole. Directional drilling is also useful in the marine environment where a single offshore production platform can reach several hydrocarbon reservoirs by utilizing a plurality of deviated wells that can extend in any direction from the drilling platform.

Directional drilling also enables horizontal drilling through a reservoir. Horizontal drilling enables a longer section of the wellbore to traverse the payzone of a reservoir, thereby permitting increases in the production rate from the well.

A directional drilling system can also be used in vertical drilling operation. Often the drill bit will veer off of a planned drilling trajectory because of an unpredicted nature of the formations being penetrated or the varying forces that the drill bit experiences. When such a deviation occurs and is detected, a directional drilling system can be used to put the drill bit back on course with the well plan.

Known methods of directional drilling include the use of a rotary steerable system ("RSS"). The drill string is rotated from the surface, and downhole RSS causes the drill bit to drill in the desired direction. RSS is preferable to utilizing a drilling motor system where the drill pipe is held rotationally stationary while mud is pumped through the motor to turn a drill bit located at the end of the mud motor. Rotating the entire drill string greatly reduces the occurrences of the drill string getting hung up or stuck during drilling from differential wall sticking and permits continuous flow of mud and cuttings to be moved in the annulus and constantly agitated by the movement of the drill string thereby preventing accumulations of cuttings in the well bore. Rotary steerable drilling systems for drilling deviated boreholes into the earth are generally classified as either "point-the-bit" systems or "push-the-bit" systems.

When drilling such a well an operator typically referred to as a directional driller is responsible for controlling and steering the drill string, or more specifically, the bottom-hole assembly (BHA), to follow a specific well plan. Steering is achieved by adjusting certain drilling parameters, for example, the rotary speed of the drill string, the flow of drilling fluid (i.e., mud), and/or the weight on bit (WOB). The directional driller also typically operates the drilling tools at the end of the drill string so that the drilling direction is straight or follows a curve. These decisions to adjust the tool settings (e.g., the drilling parameters and/or the settings of the drilling tools) are made based on a data set that is measured at the surface and/or measured downhole and transmitted back by the downhole tools. An example of the data transmitted by the tools is the inclination and the azimuth of the well, as both are measured by appropriate sensors, referred to as D&I sensors in oilfield lexicon, in the bottom-hole assembly (BHA).

PowerDrive Archer is Schlumberger's addition to the PowerDrive line of RSS. Because all external parts of the new drilling system rotate, it is able to drill high dogleg severity wells in a single run, and at a far superior rate of penetration (ROP) than a Positive Displacement Motor (PDM). This fully rotating RSS repeatedly and consistently delivers high build rates from any inclination—in field trials more than 17°/100 ft. This revolutionary full-tool rotation greatly reduces mechanical or differential sticking, rendering a much cleaner wellbore for easier well completion and more accurate well logging. PowerDrive Archer's higher "build rate" (e.g. ability to turn faster) also enables it to "kick off" (e.g. begin turning from the vertical well section) later and enter the well's horizontal section earlier, thus increasing exposure to the reservoir's pay zone and boosting potential for hydrocarbon production.

SUMMARY OF INVENTION

One aspect of the invention relates to methods for drilling a well along a planned trajectory. A method in accordance with one embodiment of the invention includes: rotating a rotary steerable system in a subterranean well to drill the well, the rotary steerable system requiring a specific control algorithm that makes changes to rotary steerable settings in increments less than a predetermined tolerance, the rotary steerable system only recognizing a predetermined set of downlink commands that are configured to control the system. Downhole data is received from the rotary steerable system while drilling the well and is processed in combination with a planned trajectory to compute a desired rotary steerable setting. The desired rotary steerable setting is compared with a current rotary steerable setting to compute a step change which is in turn compared with the predetermined tolerance. A downlink path is generated when the step change exceeds the predetermined tolerance. The downlink path consists of a plurality of the recognized downlink commands and is configured to transition the rotary steerable system in incremental steps less than the predetermined tolerance from the current rotary steerable setting to the desired rotary steerable setting. The plurality of downlink commands that make up the downlink path is sequentially downlinked to the rotary steerable system to cause the rotary steerable system to control a trajectory of drilling along the planned trajectory.

Another aspect of the invention relates to systems for drilling a well along a planned trajectory. A method according to one embodiment of the invention includes a processor and a memory storing a program having instructions for causing the processor to perform the processing, comparing, generating, and downlinking steps in the preceding method.

Other aspects and advantages of the invention will be apparent from the following description and the appended claims.

BRIEF DESCRIPTION OF DRAWINGS

FIG. 1 shows a schematic diagram illustrating RSS Toolbox which is a software utility to analyze RSS steering performance and propose recommended steering commands.

FIG. 2 illustrates a downlink command set in a steerable drilling tool.

DETAILED DESCRIPTION

Figure 3:
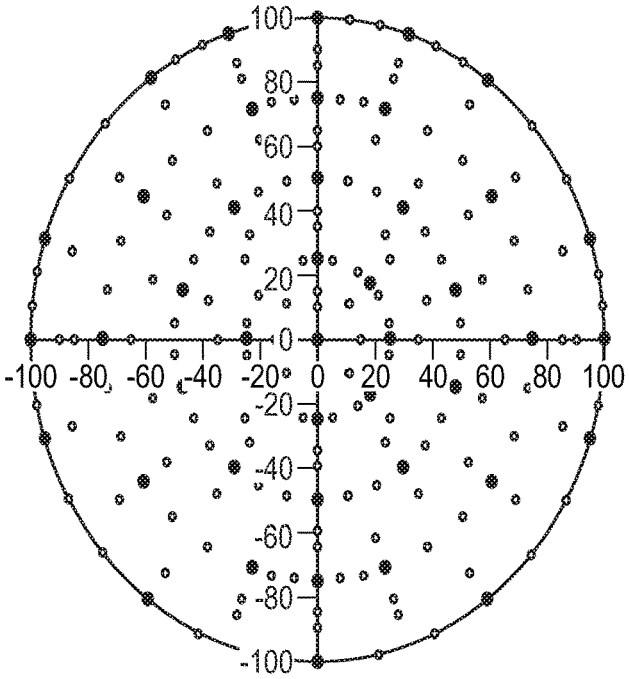
FIG. 3 illustrates a downlink command set represented in a Polar Coordinate System.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without some of these specific details. In other instances, well-known features have not been described in detail to avoid unnecessarily complicating the description.

The current invention provides a system and method of automatically controlling the trajectory of a well while drilling. To automatically control the trajectory of a well, a steering behavior model, which can be mathematical, software, or other digital form, is provided. The steering behavior model can use any methodology or tool to simulate the steering behavior of a drill string, or more specifically a bottom-hole assembly. U.S. Pat. No. 7,957,946 by Pirovolou and assigned to Schlumberger Technology Corporation, entitled "Method of automatically controlling the trajectory of a drilled well," discloses the calibration of a steering behavior model to minimize a variance between the steering behavior model of the well and the actual drilled well, which is incorporated by reference in its entirety.

In accordance with one embodiment of the invention, RSS Toolbox is a software utility to analyze RSS steering performance and propose recommended steering commands to follow a plan, as shown in FIG. 1. The system is run by Directional Drillers (DDs) whether at the rig or working remotely in an Operations Support Center (OSC). The RSS Toolbox provides DDs with a tool to quantify steering behavior and generates recommended steering commands. When the RSS Toolbox is linked to an automated downlink system such as the Schlumberger devices (DNLK, RigPulse, etc.), the calculated steering command can be sent directly from the RSS Toolbox. Based on the static survey and real time continuous direction and inclination (D&I) data, RSS Toolbox receives the data from RSS tool and learns the steering behavior of the drilling assembly, and uses the acquired information to create more accurate projections for the DDs. The software recommends the optimal command to direct the drilling tool according to plan, and also it can automatically send the command without requiring input from the DDs.

RSS Toolbox supports all sizes of Schlumberger's PowerDrive and Xceed RSS tools. But for PowerDrive Archer, the workflow needs specific algorithm to control the tool due to its very dynamic behavior. At the same time, the downlink operations should make the tool face changes in small increments. In one embodiment, PowerDrive Archer can operate and make the tool face changes in small increments (e.g. no larger than 12 degree incremental change per 15 feet before making another tool face change, or, no larger than 18 degree incremental change per 20 feet before making another tool face change etc.). The recommendation in RSS Toolbox is a desired response to BHA including a desired toolface (TF) and desired steer ratio (SR). But only a set of downlinks with specific TFs and SRs can be recognized by RSS tools. So, from the current setting of PowerDrive Archer to the recommended setting will include many downlinks to achieve the desired response. These downlinks are called downlink path. This invention provides a method to obtain the downlink path with optimal accuracy and efficiency.

FIG. 2 illustrates a downlink command set in PowerDrive Archer in accordance with one embodiment of the invention. In one embodiment, PowerDrive Archer can only recognize downlink commands listed in the downlink command set as shown in FIG. 2. In one embodiment, this invention provides a downlink path which uses configurable number of downlink commands listed in FIG. 2 to approach Desired downlink setting from Initial downlink setting of the PowerDrive Archer. Such downlink path must result with a downlink setting that is equal or very close to the Desired downlink setting while PowerDrive Archer can recognize and operate such downlink path. In addition, since PowerDrive Archer has constrain that it may have erratic steering behaviors in response to big step change in TF and SR set, the downlink path must be developed with TF changes in small increments gradually e.g. no larger than 12 degree incremental change per 15 feet before making another tool face change, or, no larger than 18 degree incremental change per 20 feet before making another tool face change etc.

FIG. 3 illustrates a downlink command set represented in a Polar Coordinate System, since most downlink commands contain a TF which is an angle and a SR which is a percentage value. In one embodiment, a downlink command is represented as a downlink point within the Polar Coordinate System, wherein the TF is represented as the angle of the downlink point, and SR is represented as the plane of the downlink point. As shown in FIG. 3, the downlink command set in FIG. 2 can be represented as multiple downlink points within the Polar Coordinate System.

Figure 4:
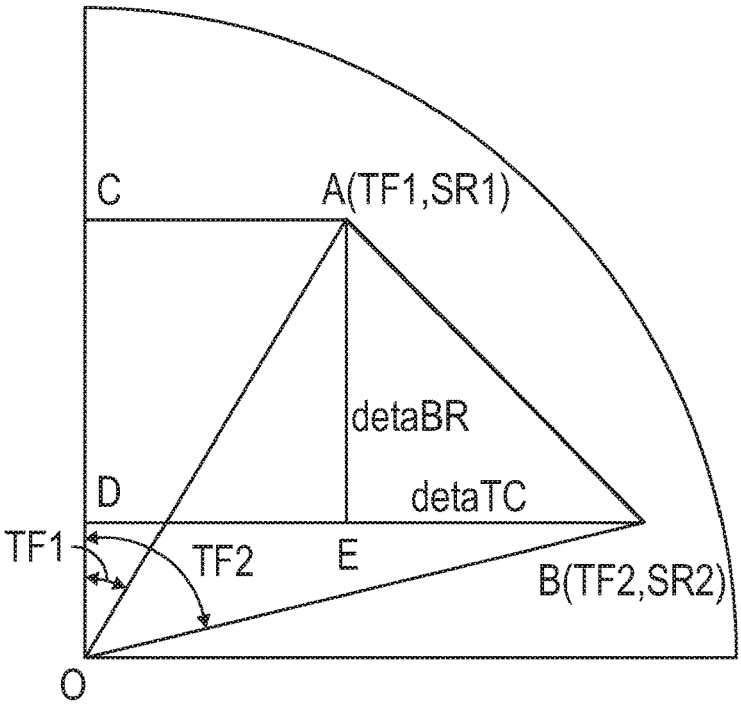
FIG. 4 illustrates the calculation of distance from one downlink setting to another downlink setting within the Polar Coordinate System.

FIG. 4 illustrates the calculation of distance from one downlink setting to another downlink setting within the Polar Coordinate System. In one embodiment, the distance between downlink point A and downlink point B can be calculated as the below Formula 1:

$$\Delta BR=|OC|-|OD|=|OA|\times\cos TF_1-|OB|\times\cos TF_2$$

$$\Delta BR=SR_1\times\cos TF_1-SR_2\times\cos TF_2$$

$$\Delta TC=|BD|-|AC|=|OB|\times\sin TF_2-|OA|\times\sin TF_1$$

$$\Delta TC=SR_1\times\sin TF_1-SR_2\times\cos TF_2$$

$$\text{distance}[(TF_1,SR_1),(TF_2,SR_2)]=|AB|=\sqrt{\Delta BR^2+\Delta TC^2} \qquad \text{Formula (1)}$$

In one embodiment, this invention incorporates Greedy Algorithm to generate a downlink path. Greedy Algorithm is an algorithm that follows the problem solving heuristic of making the locally optimal choice at each stage with the hope of finding a global optimum. Greedy algorithm looks for simple, easy-to-implement solutions to complex, multistep problems by deciding which next step will provide the most obvious benefit. On some problems, a greedy strategy need not produce an optimal solution, but nonetheless a greedy heuristic may yield locally optimal solutions that approximate a global optimal solution. Detailed information of Greedy Algorithm is found at http://en.wikipedia.org/wiki/Greedy_algorithm, which is incorporated here by reference.

Figure 5:
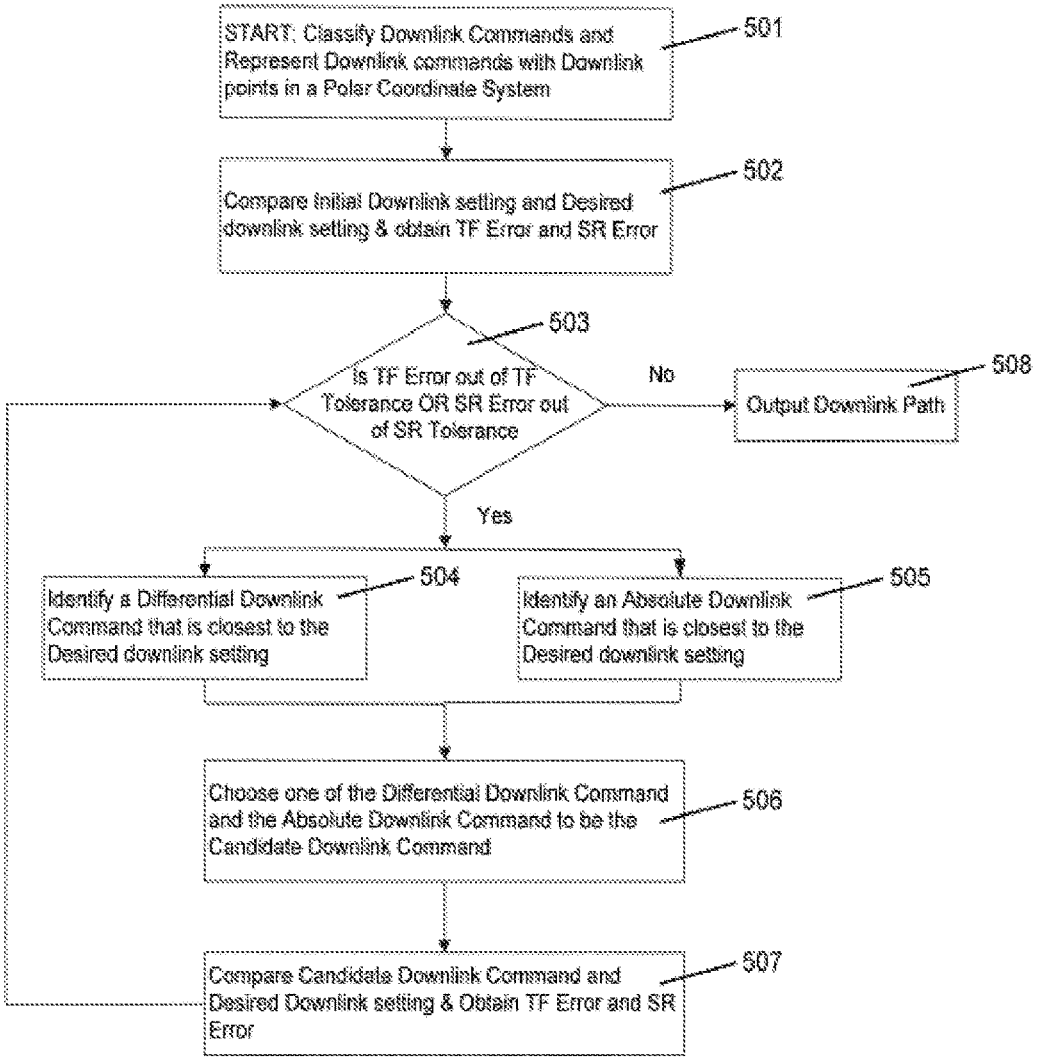
FIG. 5 shows an example of a workflow in accordance with one or more embodiments of the invention.

FIG. 5 shows a workflow of an exemplary method of the invention. In accordance with this example, methods of the invention uses Greedy Algorithm to create the downlink path with configurable number of downlink commands. In every iterative step, Greedy Algorithm chooses the Candidate downlink command which has the nearest distance with the Desired downlink setting. In one embodiment, the input of the method includes Initial downlink setting with initial TF (initial tool face of PowerDrive Archer tool) and initial SR (initial steer ratio of PowerDrive Archer tool), Desired downlink setting with desired TF (tool face which DD desires to set to PowerDrive Archer) and desired SR (steer ratio which DD desires to set to PowerDrive Archer), TF Tolerance (error tolerance of the candidate downlink command TF to desired TF, e.g. by default 6 degrees), and SR Tolerance (error tolerance of the candidate downlink command SR to desired SR, e.g. by default 10%). The TF Tolerance and SR Tolerance are configurable to guarantee the convergence of algorithm. The method of the invention outputs a downlink path which includes at least one Candidate downlink command to achieve the Desired TF and SR from the Initial TF and SR of the PowerDrive Archer.

As shown in FIG. 5, the workflow starts with classifying the downlink commands and representing the downlink commands within a Polar Coordinate System 501. The downlink commands are classified as the following three categories. The first category is Absolute downlink command with Absolute TF and SR. For example, the command 1-9 with TF=45 deg and SR=25% is an Absolute downlink command. In FIG. 2, the Absolute downlink commands include Command#1-0 to 1-31, and 2-0 to 2-12. The second category is Differential downlink command which can increase/decrease the TF and SR. For example, the command 2-13 which increases the SR 10% is a Differential downlink command. In FIG. 2, the Differential downlink commands include Command#2-13 to 2-16. The third category is Other downlink commands that are neither Absolute downlink commands nor Differential downlink commands, such as Command#2-17 to 2-31, as shown in FIG. 2. In addition, the downlink commands are represented as downlink points within a Polar Coordinate System, as shown in FIG. 3.

According to one embodiment of the invention, the workflow then compares Initial downlink setting and Desired downlink setting and obtains the TF error and SR error between the Initial downlink setting and the Desired downlink setting, step 502. For example, assuming DD needs to get the downlink path from setting TF=25 deg, SR=70% to TF=50 deg, SR=100%, the workflow receives input that the Initial downlink setting has TF=25 deg and SR=70% and the Desired downlink setting has TF=50 deg and SR=100%, the TF error and the SR error would be 50 deg−25 deg=TF error 25 deg and 100%−70%=SR error 30% respectively. According to one embodiment of the invention, PowerDrive Archer has TF Tolerance 6 degrees and SR Tolerance 10%. The input can be listed in the below Table 1.

TABLE 1

| Initial TF (degree) | Initial SR (%) | Desired TF (degree) | Desired SR (%) | TF Tolerance (degree) | SR Tolerance (%) |
|---|---|---|---|---|---|
| 25 | 70 | 50 | 100 | 6 | 10 |

According to one embodiment of the invention, the workflow then decides if either the TF error would be out of TF Tolerance or the SR error would be out of SR Tolerance, step 503. If the answer is NO that TF error<TF Tolerance and SR error<SR Tolerance, which means that those two downlink settings are close enough, the workflow then goes to Output Downlink Path 508 and downlink path is ready and recognizable to a steerable drilling tool such as PowerDrive Archer tool. If the answer is YES that either TF error>TF Tolerance or SR error>SR Tolerance or both, such as in the current scenario where TF error 25 deg>TF Tolerance 6 deg; and SR error 30%>SR Tolerance 10%, the workflow then goes to step 504 and step 505.

Figure 6:
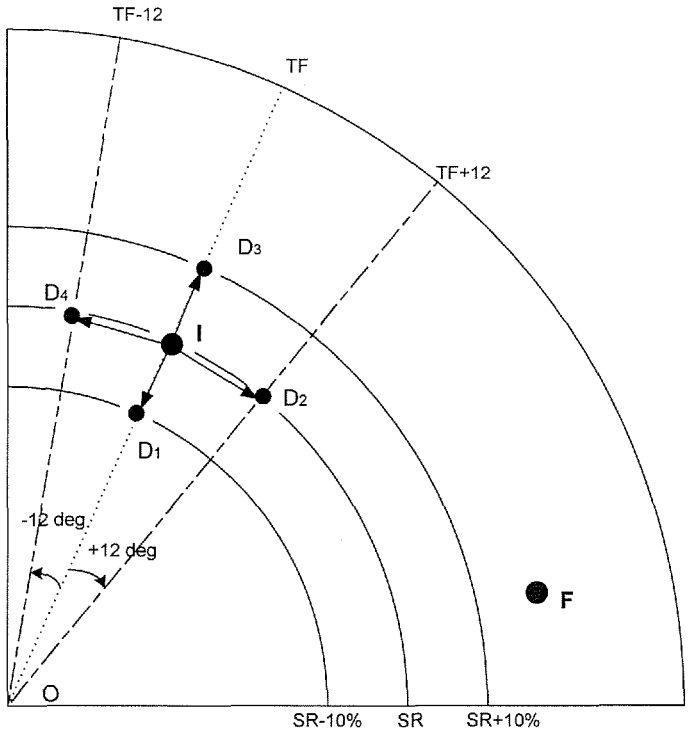
FIG. 6 illustrates the identification of Differential downlink command that is closest to the Desired downlink setting.

According to one embodiment of the invention, the workflow then identifies a Differential downlink command that is closest to the Desired downlink setting, step 504. As shown in FIG. 6, Initial downlink setting (TF=25 deg and SR=70%) is represented as downlink point I in the Polar Coordinate System, Desired downlink setting (TF=50 deg, SR=100%) is represented as downlink point F in the Polar Coordinate System respectively. Differential downlink commands related to Initial downlink setting are downlink point D1 (TF=25 deg and SR=60%), downlink point D2 (TF=37 deg and SR=70%), downlink point D3 (TF=25 deg and SR=80%), and downlink point D4 (TF=13 deg and SR=70%). The workflow then uses Formula 1 (as shown in FIG. 4) and calculates the distances between Desired downlink setting F and downlink point D1, downlink point D2, downlink point D3, and downlink point D4 respectively. The workflow then decides that downlink point D2 is the Differential downlink command that is closest to the Desired downlink setting F based on the calculation result.

Figure 7:
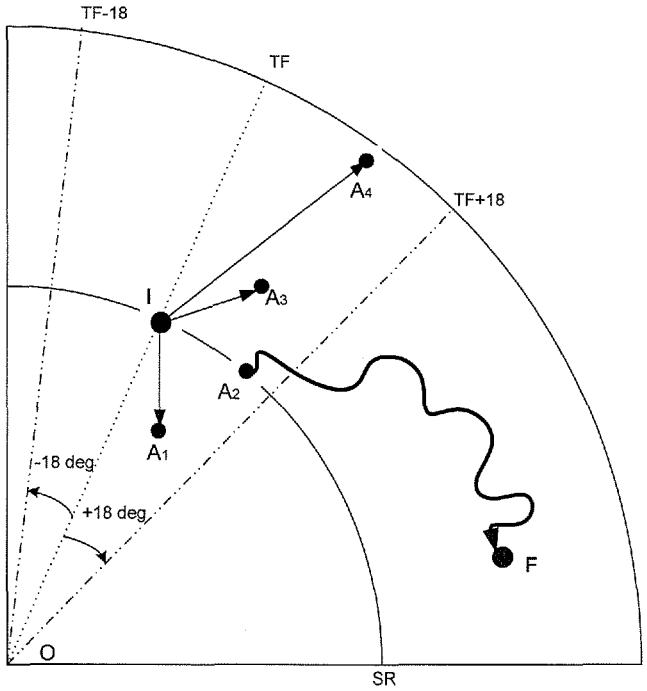
FIG. 7 illustrates the identification of Absolute downlink command that is closest to the Desired downlink setting.

According to one embodiment of the invention, the workflow then identifies an Absolute downlink command that is closest to the Desired downlink setting, step 505. Step 505 can be performed before, after or at the same time with step 504. As shown in FIG. 7, Initial downlink setting (TF=25 deg and SR=70%) is represented as downlink point I in the Polar Coordinate System, Desired downlink setting (TF=50 deg, SR=100%) is represented as downlink point F in the Polar Coordinate System respectively. Absolute downlink commands related to Initial downlink setting I are Absolute downlink commands that are within TF degree change restraint of the steerable drilling tool such as PowerDrive Archer tool (e.g. no larger than 12 degree incremental change per 15 feet before making another tool face change, or, no larger than 18 degree incremental change per 20 feet before making another tool face change etc.). According to one embodiment of the invention, as shown in FIG. 7, TF degree change restraint can be 18 degrees at most. The workflow then uses Formula 1 (as shown in FIG. 4) and calculates the distances between Desired downlink setting F and those Absolute downlink commands (A1, A2, A3, A4, etc.) respectively. The workflow then decides that downlink point A2 is the Absolute downlink command that is closest to the Desired downlink setting F based on the calculation result.

According to one embodiment of the invention, the workflow then compares the Differential downlink command resulted from step 504 and the Absolute downlink command resulted from step 505, and then chooses one of them to be the Candidate downlink command, step 506. The Candidate downlink command is the one that is closer to the Desired downlink setting between the Differential downlink command and the Absolute downlink command. In one embodiment, the workflow compares the distance from downlink point D2 to downlink point F and the distance from downlink point A2 to downlink point F, and decides that the distance from downlink point A2 to downlink point F is shorter than the distance from downlink point D2 to downlink point F, thus chooses downlink point A2 to be the Candidate downlink command.

According to one embodiment of the invention, the workflow then compares Candidate downlink command and Desired downlink setting and obtains the TF error and SR error between Candidate downlink command and the Desired downlink setting, step 507. Again, the question returns to step 503 if either the TF error would be out of TF Tolerance or the SR error would be out of SR Tolerance. If the answer is NO, the workflow then goes to Output Downlink Path 508 and downlink path is ready and recognizable to the steerable drilling tool such as PowerDrive Archer tool. If the answer is YES, the workflow then again goes to step 504 and step 505 until the question to step 503 is NO, the workflow then goes to Output Downlink Path 508 eventually. Each Candidate downlink command is recorded, and downlink path includes all Candidate downlink commands that lead the workflow from Initial downlink setting to Desired downlink setting.

Below Table 2 is one example showing the downlink path from Initial downlink setting (TF=25 deg and SR=70%) to Desired downlink setting (TF=50 deg, SR=100%) using the workflow. Absolute downlink command (#1-8 TF=36 deg, SR=100%) is identified as the first Candidate downlink command using step 504, 505 and 506, and Differential downlink command (#2-15 Increase TF by 12 degrees) is identified as the second Candidate downlink command using step 504, 505 and 506. Therefore, downlink path includes two orders Absolute downlink command (#1-8) and Differential downlink command (#2-15) that can guide the steerable drilling tool from Initial downlink setting (TF=25 deg and SR=70%) to Desired downlink setting (TF=50 deg, SR=100%).

TABLE 2

| Sending Order | Downlink command | Description |
|---|---|---|
| 1 | 1-8 | Set TF = 36 degrees, SR = 100% |
| 2 | 2-15 | Increase TF by 12 degrees |

Below Table 3 is one example showing the downlink path resulting with 96.5% accuracy which is very close to the target and can be accepted by DD.

TABLE 3

| No. Of Commands | Resulting TF (degree) | Resulting SR (%) | ΔTF (degree) | ΔSR (100%) | Accuracy (%) |
|---|---|---|---|---|---|
| 2 | 48 | 100 | −2 | 0 | 96.5 |

Although the above example shows the downlink path only includes two orders that can guide the steerable drilling tool from Initial downlink setting to Desired downlink setting, in some situation it may take many orders which goes against the DD's real job experience, because of the big difference (e.g. large TF change) between Initial downlink setting the Desired downlink setting. In such situation (e.g. three or more orders are needed according to the downlink path), DD can alternatively reset Initial downlink setting to be Neutral Command #1-0 (TF=0 deg and SR=0%) and process the current workflow, which may result with better performance.

Figure 8:
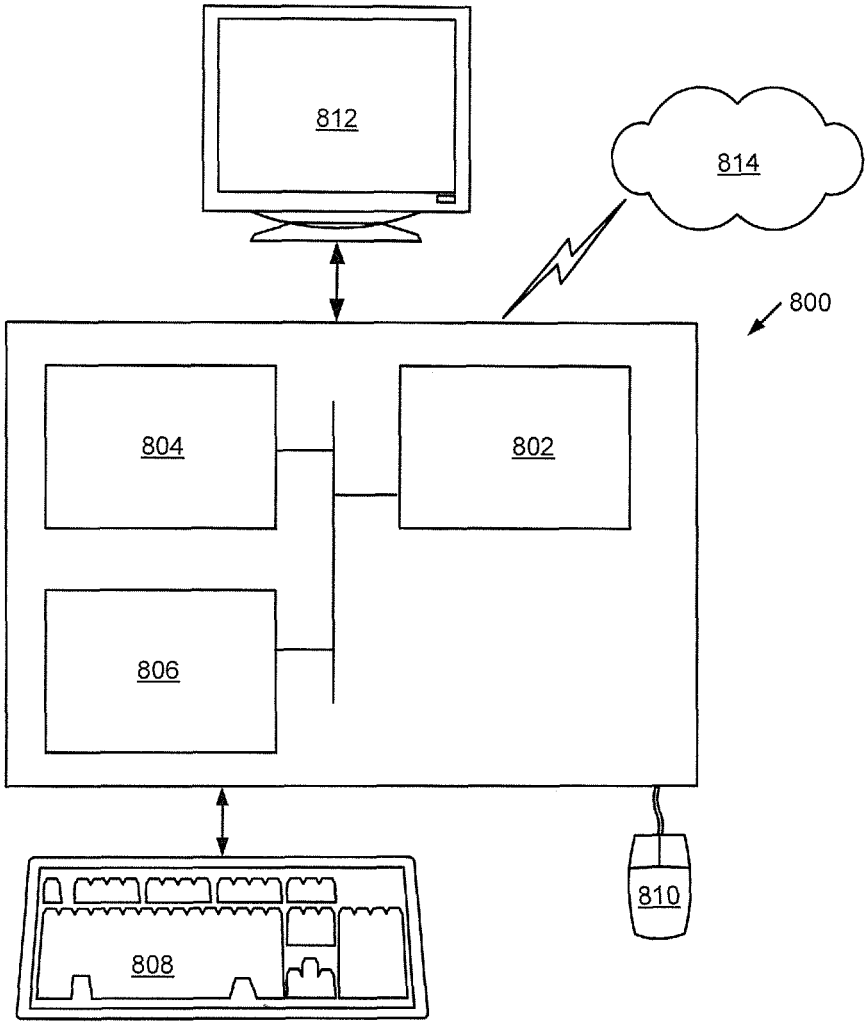
FIG. 8 shows an example of a computer system in accordance with one or more embodiments of the invention.

Embodiments of the invention may be implemented on virtually any type of computer regardless of the platform being used. For example, as shown in FIG. 8, a computer system (800) includes one or more processor(s) (802), associated memory (804) (e.g., random access memory (RAM), cache memory, flash memory, etc.), a storage device (806) (e.g., a hard disk, an optical drive such as a compact disk drive or digital video disk (DVD) drive, a flash memory stick, etc.), and numerous other elements and functionalities typical of today's computers (not shown). The computer (800) may also include input means, such as a keyboard (808), a mouse (810), or a microphone (not shown). Further, the computer (800) may include output means, such as a monitor (812) (e.g., a liquid crystal display (LCD), a plasma display, or cathode ray tube (CRT) monitor). The computer system (800) may be connected to a network (814) (e.g., a local area network (LAN), a wide area network (WAN) such as the Internet, or any other similar type of network) via a network interface connection (not shown). Those skilled in the art will appreciate that many different types of computer systems exist, and the aforementioned input and output means may take other forms. Generally speaking, the computer system (800) includes at least the minimal processing, input, and/or output means necessary to practice embodiments of the invention.

Further, those skilled in the art will appreciate that one or more elements of the aforementioned computer system (800) may be located at a remote location and connected to the other elements over a network. Further, embodiments of the invention may be implemented on a distributed system having a plurality of nodes, where each portion of the invention (e.g., display, formation data, analysis device, etc.) may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for drilling a well along a planned trajectory, the method comprising:

(a) rotating a rotary steerable system in a subterranean well to drill the well, the rotary steerable system requiring a specific control algorithm that makes changes to rotary steerable settings in a plurality of incremental steps less than a predetermined tolerance, the rotary steerable system only recognizing a predetermined set of downlink commands, the downlink commands controlling the rotary steerable system;

(b) receiving downhole data from the rotary steerable system while drilling the well in (a);

(c) processing the downhole data received in (b) in combination with the planned trajectory to compute a desired rotary steerable setting;

(d) comparing the desired rotary steerable setting with a current rotary steerable setting to compute a step change;

(e) comparing the step change with the predetermined tolerance;

(f) generating a downlink path when the step change computed in (d) exceeds the predetermined tolerance in (e), the downlink path consisting of a plurality of the downlink commands recognized in (a), the downlink path transitioning the rotary steerable system in incremental steps less than the predetermined tolerance from the current rotary steerable setting to the desired rotary steerable setting computed in (c); and (g) sequentially downlinking the plurality of downlink commands that make up the downlink path generated in (f) to the rotary steerable system to change the rotary steerable setting from the current rotary steerable setting to the desired rotary steerable setting computed in (c) via the plurality of incremental steps, each of which is less than the predetermined tolerance to cause the rotary steerable system to control a trajectory of drilling along the planned trajectory.

2. The method of claim 1, wherein generating the downlink path in (f) comprises:

identifying a differential downlink command from the plurality of downlink commands recognized in (a) and an absolute downlink command from the plurality of downlink commands recognized in (a);

(ii) selecting one of the differential downlink command and the absolute downlink command as one of the plurality of downlink commands in the downlink path;

(iii) repeating (i) and (ii) to iteratively select additional ones of the plurality of downlink commands in the downlink path until the step change computed in (d) is less than the predetermined tolerance in (e).

3. The method of claim 1, wherein each of the plurality of downlink commands in the downlink path is expressed in Polar Coordinate System.

4. The method of claim 3, wherein (f) further comprises calculating a distance between each of the plurality of downlink commands in the downlink path and the desired steering tool setting computed in (c) within the Polar Coordinate System.

5. The method of claim 1, wherein each of the plurality of downlink commands in the downlink path is acceptable to the rotary steerable system.

6. The method of claim 1, wherein generating the downlink path in (f) comprises using a Greedy Algorithm.

7. The method of claim 1, wherein:

the rotary steerable setting comprises toolface and steering ratio; and the predetermined tolerance comprises a toolface tolerance of six degrees and a steering ratio tolerance of 10 percent.

8. The method of claim 1, wherein:

the rotary steerable setting comprises a toolface and a steering ratio; and generating the downlink path in (f) further comprises:

(i) identifying a first plurality of candidate commands from among the predetermined set of downlink commands, wherein each of the first plurality of candidate commands is less than the predetermined tolerance from the current rotary steerable setting;

(ii) computing a distance in polar coordinates between each of the first plurality of candidate commands and the desired rotary steerable setting; and (iii) selecting a candidate command among the first plurality of candidate commands having the smallest distance in (ii).

9. The method of claim 8, wherein (f) further comprises (iv) identifying a second plurality of candidate commands from among the predetermined set of downlink commands when the candidate command exceeds the predetermined tolerance compared to the desired rotary steerable setting, wherein each of the second plurality of candidate commands is less than the predetermined tolerance from the candidate command selected in (iii);

(v) computing a distance in polar coordinates between each of the candidate commands in the second plurality and the desired rotary steerable setting; and (vi) selecting the candidate command having the smallest distance in (v).

10. A rotary steerable system for drilling a well along a planned trajectory, the system comprising a processor and a memory storing a program having instructions for causing the processor to perform the steps of:

(a) receiving a predetermined set of downlink commands, the downlink commands controlling the rotary steerable system, the rotary steerable system requiring a specific control algorithm that makes changes to rotary steerable settings in a plurality of incremental steps less than a predetermined tolerance, the rotary steerable system only recognizing said predetermined set of downlink commands;

(b) receiving downhole data from the rotary steerable system while drilling the well;

(c) processing the downhole data received in (b) in combination with the planned trajectory to compute a desired rotary steerable setting;

(d) comparing the desired rotary steerable setting with a current rotary steerable setting to compute a step change;

(e) comparing the step change with the predetermined tolerance;

(f) generating a downlink path when the step change computed in (d) exceeds the predetermined tolerance in (e), the downlink path consisting of a plurality of the downlink commands received in (a), the downlink path transitioning the rotary steerable system in incremental steps less than the predetermined tolerance from the current rotary steerable setting to the desired rotary steerable setting computed in (c); and (g) sequentially downlinking the plurality of downlink commands that make up the downlink path generated in (f) to the rotary steerable system to change the rotary steerable setting from the current rotary steerable setting to the desired rotary steerable setting computed in (c) via the plurality of incremental steps, each of which is less than the predetermined tolerance to cause the rotary steerable system to control a trajectory of drilling along the planned trajectory.

11. The system of claim 10, wherein generating the downlink path in (f) comprises:

identifying a differential downlink command from the plurality of downlink commands received in (a) and an absolute downlink command from the plurality of downlink commands received in (a);

(ii) selecting one of the differential downlink command and the absolute downlink command as one of the plurality of downlink commands in the downlink path;

(iii) repeating (i) and (ii) to iteratively select additional ones of the plurality of downlink commands in the downlink path until the step change computed in (d) is less than the predetermined tolerance in (e).

12. The system of claim 11, wherein each of the plurality of downlink commands in the downlink path is expressed in Polar Coordinate System.

13. The method of claim 12, wherein (f) further comprises calculating a distance between each of the plurality of downlink commands in the downlink path and the desired steering tool setting computed in (c) within the Polar Coordinate System.

14. The method of claim 11, wherein each of the plurality of downlink commands in the downlink path is acceptable to the rotary steerable system.

15. The method of claim 11, wherein generating the downlink path in (f) comprises using a Greedy Algorithm.

16. A non-transitory computer readable medium storing a program having instructions for causing a processor of a rotary steerable system for drilling a well along a planned trajectory, the processor performing the steps of:

(a) receiving a predetermined set of downlink commands, the downlink commands controlling the rotary steerable system, the rotary steerable system requiring a specific control algorithm that makes changes to rotary steerable settings in a plurality of incremental steps less than a predetermined tolerance, the rotary steerable system only recognizing said predetermined set of downlink commands;

(b) receiving downhole data from the rotary steerable system while drilling the well;

(c) processing the downhole data received in (b) in combination with the planned trajectory to compute a desired rotary steerable setting;

(d) comparing the desired rotary steerable setting with a current rotary steerable setting to compute a step change;

(e) comparing the step change with the predetermined tolerance;

(f) generating a downlink path when the step change computed in (d) exceeds the predetermined tolerance in (e), the downlink path consisting of a plurality of the downlink commands received in (a), the downlink path transitioning the rotary steerable system in incremental steps less than the predetermined tolerance from the current rotary steerable setting to the desired rotary steerable setting computed in (c); and (g) sequentially downlinking the plurality of downlink commands that make up the downlink path generated in (f) to the rotary steerable system to change the rotary steerable setting from the current rotary steerable setting to the desired rotary steerable setting computed in (c) via the plurality of incremental steps, each of which is less than the predetermined tolerance to cause the rotary steerable system to control a trajectory of drilling along the planned trajectory.

* * * * *